US010590811B1

(12) United States Patent
Zehan

(10) Patent No.: US 10,590,811 B1
(45) Date of Patent: Mar. 17, 2020

(54) COUPLER FOR A CAMSHAFT PHASER ARRANGEMENT FOR A CONCENTRIC CAMSHAFT ASSEMBLY

(71) Applicant: SCHAEFFLER TECHNOLOGIES AG & CO KG, Herzogenaurach (DE)

(72) Inventor: Dan Zehan, Windsor (CA)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/193,140

(22) Filed: Nov. 16, 2018

(51) Int. Cl.
*F01L 1/344* (2006.01)
*F01L 1/047* (2006.01)

(52) U.S. Cl.
CPC ... *F01L 1/34413* (2013.01); *F01L 2001/0473* (2013.01); *F01L 2001/34489* (2013.01); *F01L 2001/34493* (2013.01); *F01L 2001/34496* (2013.01); *F01L 2201/00* (2013.01)

(58) Field of Classification Search
CPC ..... F01L 2001/0473; F01L 2001/0535; F01L 1/267; F01L 1/344; F01L 1/3442; F01L 2001/3445; F01L 2001/34483; F01L 2001/34489; F01L 2001/34493; F01L 2001/34496; F01L 1/46; F01L 2013/103; F01L 2820/032
USPC ..... 123/90.15, 90.17, 90.27
See application file for complete search history.

(56) References Cited

U.S. PATENT DOCUMENTS

| | | | | |
|---|---|---|---|---|
| 6,725,817 | B2 | 4/2004 | Methley et al. | |
| 7,841,311 | B2 | 11/2010 | Hutcheson et al. | |
| 8,051,818 | B2 | 11/2011 | Myers et al. | |
| 8,191,521 | B2 | 6/2012 | Kandolf et al. | |
| 8,201,528 | B2 | 6/2012 | Knecht et al. | |
| 8,887,676 | B2 | 11/2014 | Methley et al. | |
| 9,080,474 | B2 | 7/2015 | Wigsten et al. | |
| 9,366,159 | B2 | 6/2016 | Wigsten et al. | |
| 2010/0089353 | A1 | 4/2010 | Myers et al. | |
| 2010/0093453 | A1* | 4/2010 | Myers | F01L 1/3442 464/160 |
| 2010/0186698 | A1* | 7/2010 | Pluta | F01L 1/3442 123/90.17 |
| 2018/0274400 | A1 | 9/2018 | Berwinkl et al. | |

FOREIGN PATENT DOCUMENTS

| | | | |
|---|---|---|---|
| DE | 102009041755 | A1 | 4/2010 |
| DE | 102014212615 | A1 | 12/2015 |
| WO | 2017/042302 | A1 | 3/2017 |

* cited by examiner

*Primary Examiner* — Jorge L Leon, Jr.
(74) *Attorney, Agent, or Firm* — Matthew V. Evans

(57) ABSTRACT

A camshaft phaser arrangement configured for a concentric camshaft having inner and outer camshafts is provided. The camshaft phaser arrangement includes a first camshaft phaser and a second camshaft phaser. Each of the camshaft phasers is configured to be connected to either the inner or the outer camshaft. One or more couplers are arranged to torsionally couple the first camshaft phaser to the second camshaft phaser. A first end of the coupler is received by a radial slot configured within either the first or second phaser.

20 Claims, 6 Drawing Sheets

COUPLER FOR A CAMSHAFT PHASER ARRANGEMENT FOR A CONCENTRIC CAMSHAFT ASSEMBLY

TECHNICAL FIELD

Example aspects described herein relate to camshaft phasers, and, more particularly, to camshaft phasers utilized within an internal combustion (IC) engine having a concentric camshaft assembly.

BACKGROUND

Camshaft phasers are utilized within IC engines to adjust timing of an engine valve event to modify performance, efficiency and emissions. Hydraulically actuated camshaft phasers can be configured with a rotor and stator arrangement. The rotor can be attached to a camshaft and actuated hydraulically in clockwise or counterclockwise directions relative to the stator to achieve variable engine valve timing. Electric camshaft phasers can be configured with a gearbox and an electric motor to phase a camshaft to achieve variable engine valve timing.

Many different camshaft configurations are possible within an IC engine. Some camshaft configurations include an intake camshaft that only actuates intake valves, and an exhaust camshaft that only actuates exhaust valves; such camshaft configurations can often simplify efforts to independently phase the intake valve events separately from the exhaust valve events. Other camshaft configurations can utilize a single camshaft to actuate both intake and exhaust valves; however, a single camshaft configured with both intake and exhaust lobes proves difficult to provide independent phasing of the intake and exhaust valves. For single camshaft configurations, a concentric camshaft assembly can be implemented that utilizes an inner camshaft and an outer camshaft, each arranged with one of either exhaust lobes or intake lobes, with each of the camshafts having a designated camshaft phaser to vary the respective engine valve timing.

One known camshaft phaser arrangement for a concentric camshaft assembly includes a first and a second camshaft phaser that are stacked coaxially at an end of the concentric camshaft assembly. A solution is needed that facilitates connection of this camshaft phaser arrangement to the concentric camshaft assembly while torsionally or rotationally coupling the two camshaft phasers to a crankshaft of the IC engine.

SUMMARY

A camshaft phaser arrangement configured for a concentric camshaft having inner and outer camshafts is provided. The camshaft phaser arrangement includes a first camshaft phaser and a second camshaft phaser. Each of the camshaft phasers is configured to be connected to either the inner or the outer camshaft. One or more couplers are arranged to torsionally couple the first camshaft phaser to the second camshaft phaser. A first end of the one or more couplers is received by one or more radial slots configured within either the first or second camshaft phaser. A second end of the one or more couplers is connected to whichever of the camshaft phasers that does not receive the first end. The one or more radial slots can be configured to allow radial and axial movement of the one or more couplers.

In one embodiment, the first camshaft phaser is arranged axially outward of the second camshaft phaser. In one aspect of this embodiment, the one or more radial slots are arranged on the first camshaft phaser and the second end of the one or more couplers is connected to the second camshaft phaser. In another aspect of this embodiment, the one or more radial slots can be arranged on one or more protrusions that extend from the first camshaft phaser. In another aspect of this embodiment, the one or more couplers can be a cylindrical pin. The cylindrical pin can be received by an aperture arranged within the second camshaft phaser. In yet another aspect of this embodiment, the one or more couplers can be a bolt. The bolt can include a shoulder and a second end that is formed with external threads that are received by an aperture formed with internal threads in the second camshaft phaser. The second end of the bolt can be connected to a cover of the second camshaft phaser.

Either the first or second camshaft phaser can include a drive wheel that is configured with a power transmission interface that can engage with a belt, chain, gear, or any other power transmission component that connects either of the first and second camshaft phasers to a power source within an IC engine. In one embodiment, the one or more radial slots are arranged within the drive wheel.

In one embodiment, one or more couplers are arranged to attach a front cover and a rear cover to a second camshaft phaser. In one aspect of this embodiment, the one or more couplers are configured with external threads that engage with the front cover. In another aspect of this embodiment, the one or more couplers serve as a bias spring support.

In one embodiment, a first camshaft phaser, arranged axially outward of a second camshaft phaser, is configured to be connected to an inner camshaft of a concentric camshaft assembly, and a second camshaft phaser is configured to be connected to an outer camshaft of the concentric camshaft assembly.

In any of the previously described embodiments, the first and second camshaft phasers can include at least one hydraulically actuated camshaft phaser or at least one electrically actuated camshaft phaser.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
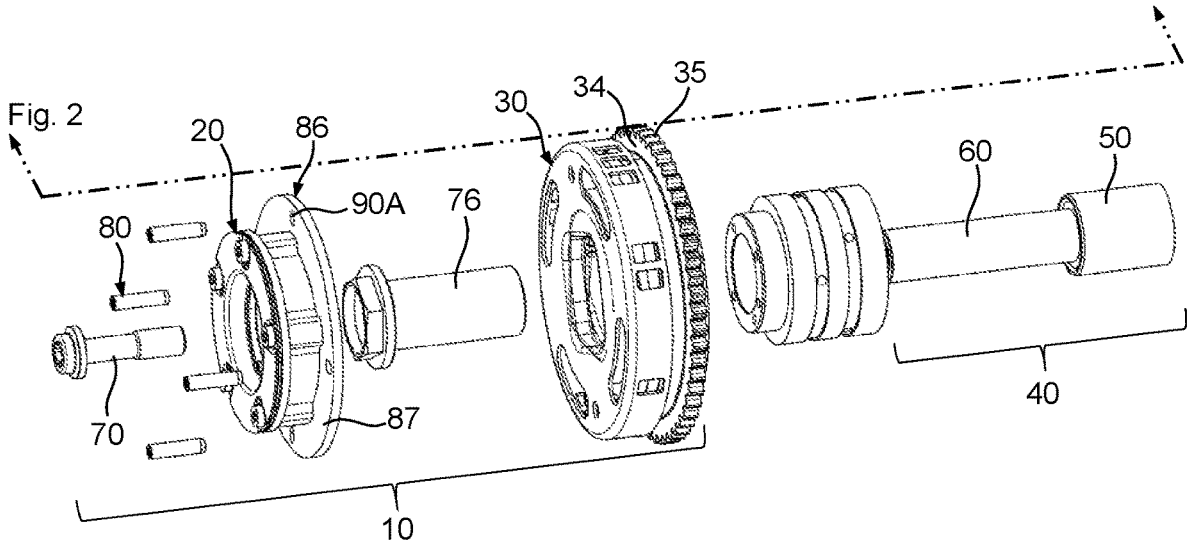
FIG. 1 is an exploded perspective view of a camshaft phaser arrangement configured for a concentric camshaft assembly that includes couplers arranged to torsionally couple a first camshaft phaser to a second camshaft phaser.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Figure 2:
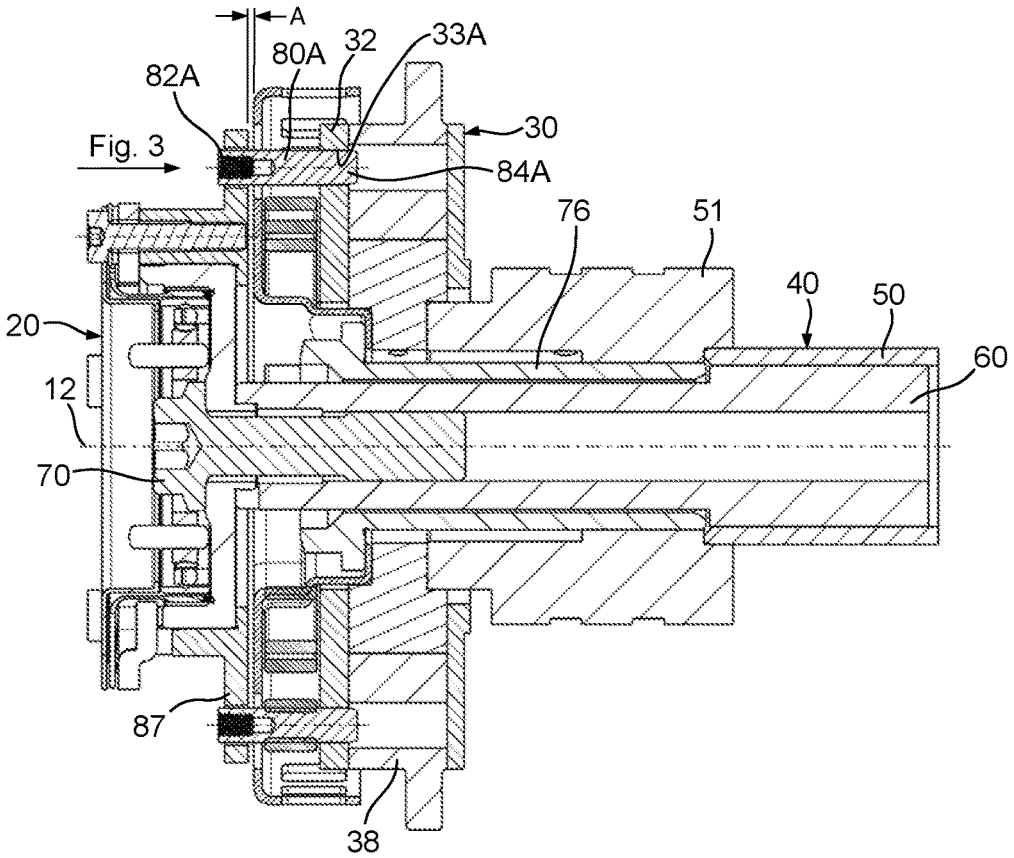
FIG. 2 is a cross-sectional view of the assembled components of FIG. 1.
Figure 3:
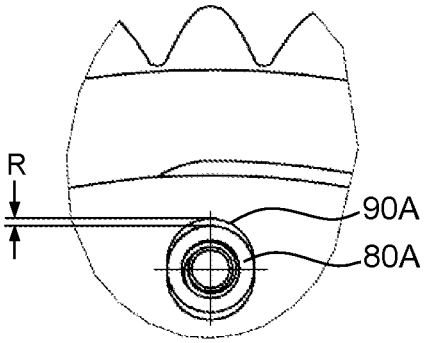
FIG. 3 is a partial front view taken from FIG. 2.

Referring to FIG. 1, an exploded perspective view of an example embodiment of a camshaft phaser arrangement 10 configured for a concentric camshaft assembly 40 is shown. FIG. 2 shows a cross-sectional view of the assembled components of FIG. 1. FIG. 3 shows a partial front view taken from FIG. 2. The following discussion should be read in light of FIGS. 1 through 3. The camshaft phaser arrangement 10 includes a rotational axis 12, a first camshaft phaser 20, a second camshaft phaser 30, and couplers 80 that torsionally couple the two camshaft phasers 20, 30. The first camshaft phaser 20 is arranged axially adjacent to the second phaser 30 such that the first camshaft phaser 20 is axially outward of the second camshaft phaser 30. The concentric camshaft assembly 40 includes an outer camshaft 50 and an inner camshaft 60.

For the example embodiment shown in FIGS. 1 through 3, the inner camshaft 60 is connected to the first camshaft phaser 20 by a first cam bolt 70, and the outer camshaft 50 is connected to the second camshaft phaser 30 by a second cam bolt 76. As shown in FIG. 2, the second camshaft phaser 30 is axially clamped to a journal bearing 51 that is attached to the outer camshaft 50 by the second cam bolt 76. Other forms of attachment methods are also possible. It could also be possible to connect the inner camshaft 60 to the second camshaft phaser 30 and the outer camshaft 50 to the first camshaft phaser 20.

The couplers 80, numbering four in the figures, could be of any quantity including one. The couplers 80 can serve to torsionally couple the two camshaft phasers 20, 30, while permitting axial and radial freedom between the two camshaft phasers 20, 30. Given that the first camshaft phaser 20 is rigidly mounted to the inner camshaft 60, resultant axial and radial locations of the first camshaft phaser 20 vary due to manufacturing tolerances of several components, including, but not limited to the first camshaft phaser 20, the outer camshaft 50, the concentric camshaft assembly 40, and a housing (not shown), such as a cylinder head of an IC engine, that receives the concentric camshaft assembly 40. Furthermore, rigid mounting of the second camshaft phaser 30 to the outer camshaft 50 combined with component manufacturing tolerances also varies the axial and radial locations of the second camshaft phaser 30.

In the example embodiment shown in FIGS. 1 through 3, the second camshaft phaser 30 includes a drive wheel 34 with a power transmission interface 35. The power transmission interface 35 can engage with either a belt, chain, gear or any power transmission component that connects the camshaft phaser arrangement 10 to a crankshaft (not shown) or any other power source within an IC engine. The couplers 80 facilitate a torsional connection between the drive wheel 34 and the first camshaft phaser 20. Stated more specifically, the couplers 80 facilitate a torsional connection between a front cover 32 that is connected to the drive wheel 34 and an outer housing 86 of the first camshaft phaser 20. It could also be possible for the couplers 80 to facilitate a torsional connection between a stator 38, also connected to the drive wheel 34 and the first camshaft phaser 20. Referring to a first coupler 80A, a first end 82A of the first coupler 80A is received by a first radial slot 90A arranged in a flange 87 formed in the outer housing 86 of the first camshaft phaser 20. The first radial slot 90A can allow radial and axial movement of the first end 82A of the first coupler 80A. A second end 84A of the first coupler 80A is connected to the front cover 32 of the second camshaft phaser 30. As shown, an interference fit between the second end 84A of the first coupler 80A and an aperture 33A within the front cover 32 can facilitate this connection, however, other connection designs are also possible.

Referring to FIGS. 2 and 3, the couplers 80 fulfill a torsional connection role while permitting: 1). Axial offset A flexibility between the first camshaft phaser 20 and the second camshaft phaser 30; and, 2). Radial offset R flexibility between the first camshaft phaser 20 and the second camshaft phaser 30. Both the axial offset A and radial offset R flexibilities can not only help endure assembly location variability due to the previously described manufacturing tolerances, but also location variability of the first and second camshaft phasers 20, 30 during use of the IC engine. For example, axial and radial valve train forces that act on the inner camshaft 60 are likely different than axial and radial valve train forces that act on the outer camshaft 50, which can translate to unequal axial and radial movements of the first camshaft phaser 20 and the second camshaft phaser 30 that are connected to these respective components. In addition, a power transmission interface force that is applied to the drive wheel 34 of the second camshaft phaser 30, likely results in a different resultant motion and position of the second camshaft phaser 30 relative to the first camshaft phaser 20.

Figure 4A:
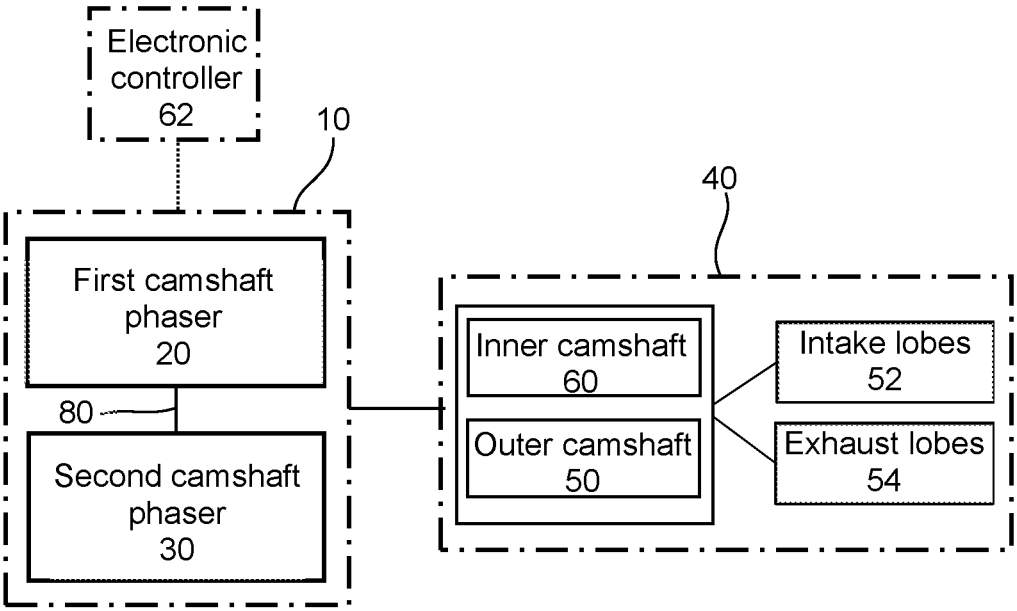
FIG. 4A is a schematic diagram of the camshaft phaser arrangement of FIG. 1 together with an electronic controller, depicting a flexible location of intake and exhaust camshaft lobes within the concentric camshaft assembly.

The camshaft phaser arrangement 10 for the concentric camshaft assembly 40 provides independent phasing of the inner camshaft 60 relative to the outer camshaft 50. Referring to FIG. 4A, a schematic diagram of the camshaft phaser arrangement 10 is shown together with an electronic controller 62, and the concentric camshaft assembly 40. The camshaft phaser arrangement 10 can be controlled by the electronic controller 62; this electronic controller 62 can possibly be an electronic control unit (ECU) that controls an IC engine. The concentric camshaft assembly 40 includes intake lobes 52 and exhaust lobes 54, each of which can be arranged on either the inner camshaft 60 or the outer camshaft 50. In some engine design instances, it may prove advantageous to have the outer camshaft 50 configured with the exhaust lobes 54 and the inner camshaft 60 to be configured with the intake lobes 52, however, this arrangement could also be reversed.

Figure 5:
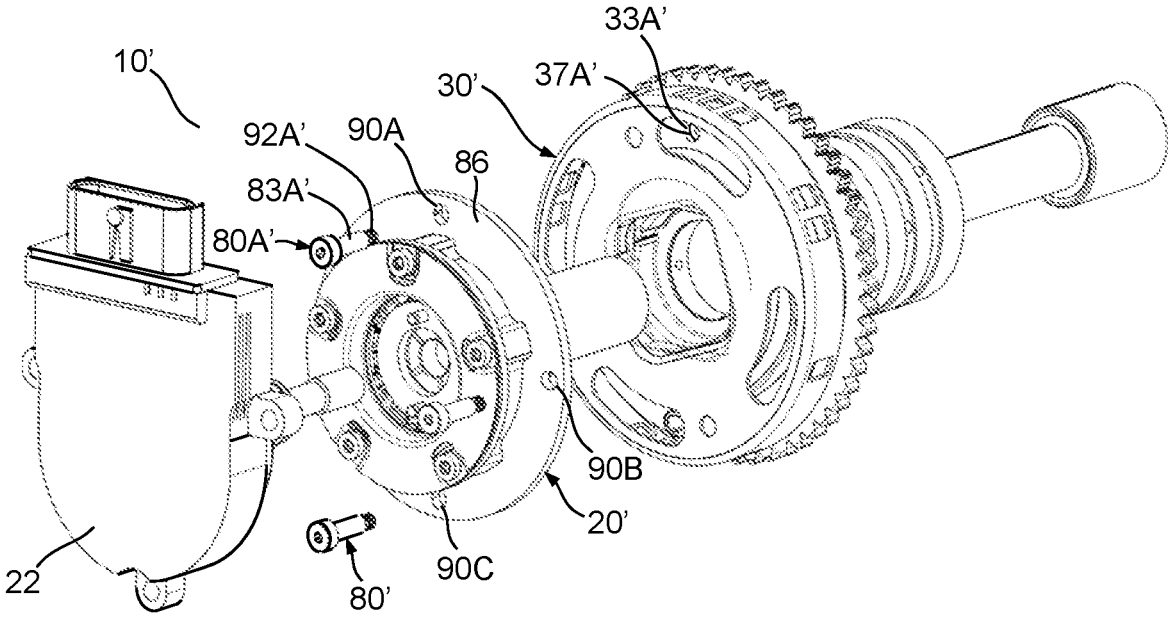
FIG. 5 is an exploded perspective view of a camshaft phaser arrangement configured for a concentric camshaft assembly that includes couplers arranged to torsionally couple a first camshaft phaser to a second camshaft phaser.
Figure 6:
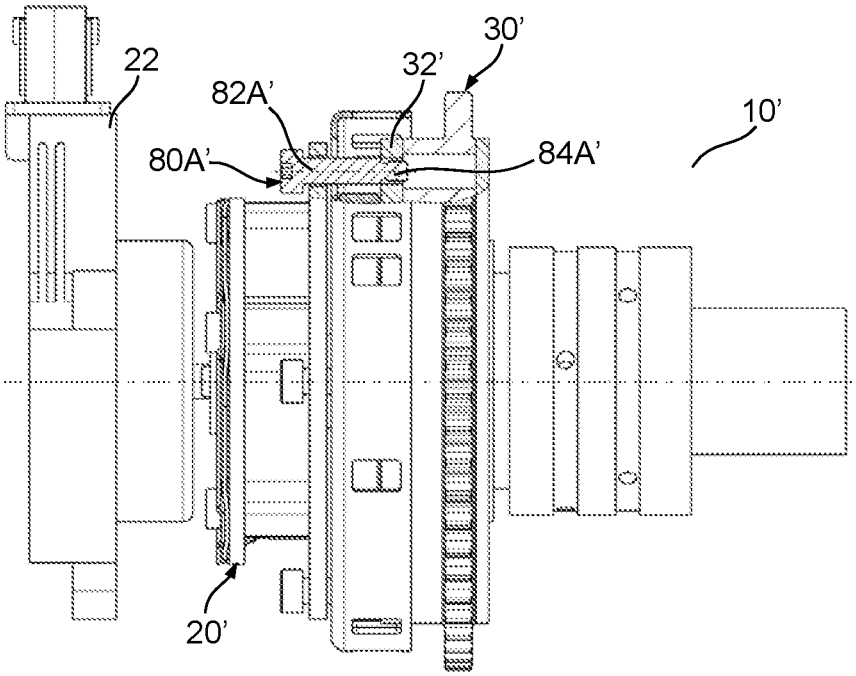
FIG. 6 is a partial cross-sectional view taken from FIG. 5.

Another example embodiment of a camshaft phaser arrangement 10' for the concentric camshaft assembly 40 is shown in FIGS. 5 and 6. The first camshaft phaser 20' is shown with an electric motor 22 for actuation purposes, thus, classifying it as an "electric camshaft phaser." In this embodiment, a first coupler 80A' is formed with a shoulder 83A' that is received by the first radial slot 90A; a second end 84A' of the first coupler 80A' is formed with external threads 92A' that are received by internal threads 37A' formed within an aperture 33A' of a front cover 32'. A first end 82A' of the first coupler 80A' can be of any functional shape to receive an installation tool.

Figure 7:
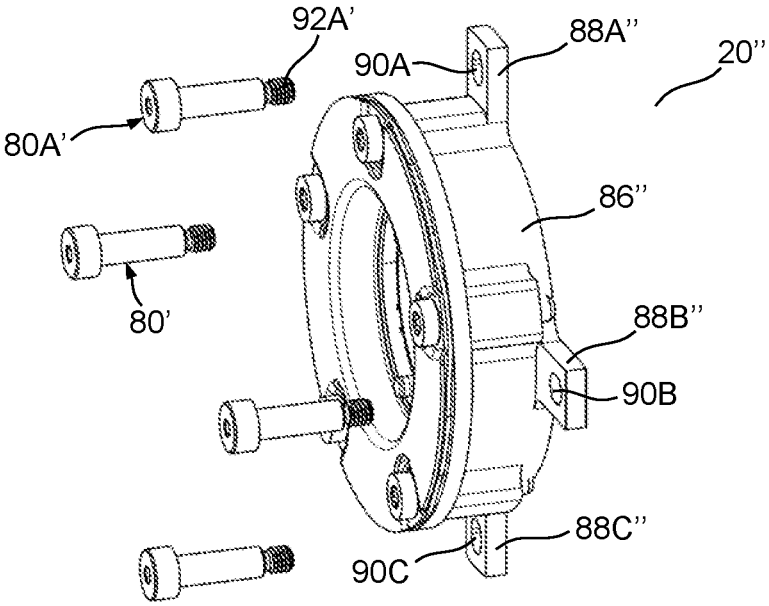
FIG. 7 is an exploded perspective view of a camshaft phaser having protrusions to receive the couplers of FIG. 5.

An example embodiment of an outer housing 86" of a first camshaft phaser 20" is shown in FIG. 7. The outer housing 86" is configured with visible protrusions 88A", 88B", 88C" (a fourth protrusion is not visible) having respective radial slots 90A, 90B, 90C to receive the couplers 80'. This example embodiment shows one of many possible outer housing designs that are possible to receive the couplers 80'.

Figure 8:
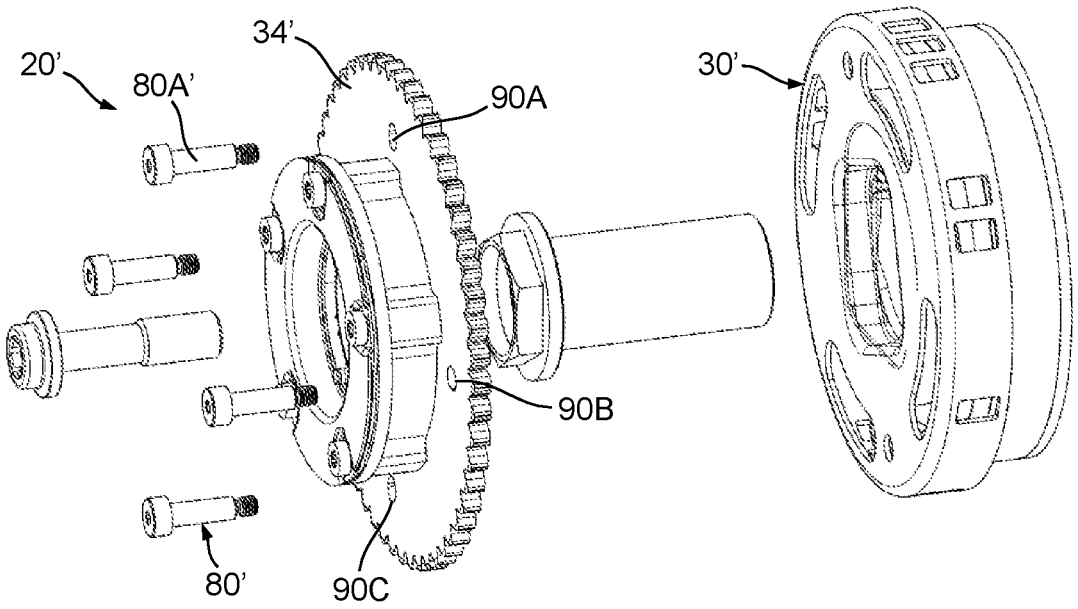
FIG. 8 is an exploded perspective view of a camshaft phaser arrangement for a concentric camshaft assembly with a drive wheel on a first camshaft phaser that receives the couplers of FIG. 5.

In an example embodiment shown in FIG. 8, a drive wheel 34' is connected to a first camshaft phaser 20' instead of a second camshaft phaser 30', as shown in previous example embodiments. The drive wheel 34' is configured with radial slots 90A, 90B, 90C that receive the couplers 80'.

Figure 9:
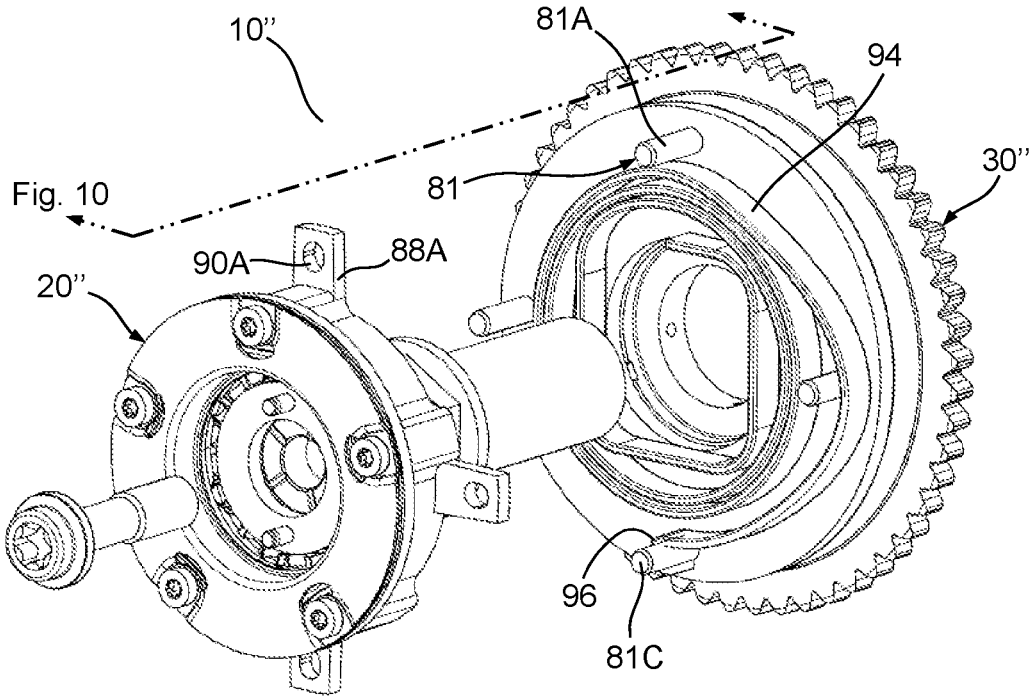
FIG. 9 is an exploded perspective view of a camshaft phaser arrangement for a concentric camshaft assembly that includes couplers arranged to assemble a second camshaft phaser while also torsionally coupling a first camshaft phaser to the second camshaft phaser.
Figure 10:
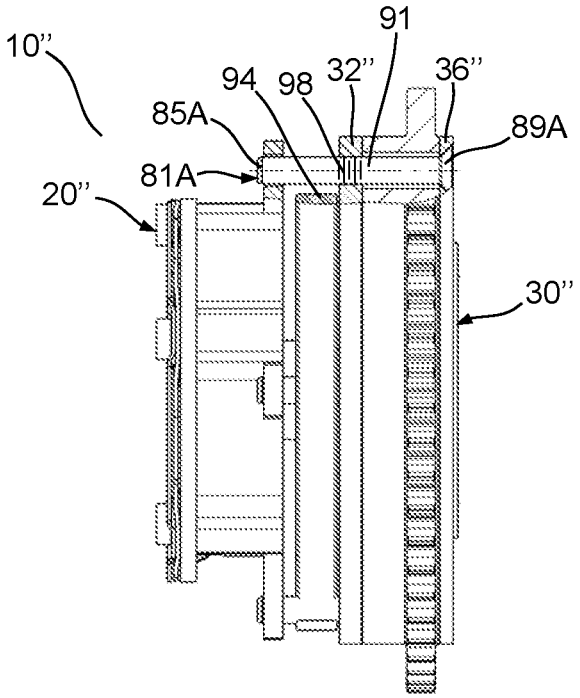
FIG. 10 is a partial cross-sectional view of the assembled camshaft phaser arrangement of FIG. 9.

FIGS. 9 and 10 show an example embodiment of a camshaft phaser arrangement 10" having couplers 81 that torsionally couple a first camshaft phaser 20" to a second camshaft phaser 30". A first coupler 81A, amongst the one or more couplers 81, has a first end 85A that is received by the first radial slot 90A configured within the first camshaft phaser 20" and a second end 89A that is connected to a second camshaft phaser 30". As shown in FIG. 10, the second end 89A engages a rear cover 36", and a medial portion 91 of the first coupler 81A is formed with external threads 98 that engage with a front cover 32" of the second camshaft phaser 30". Additionally, any one of the couplers 81 can serve as a bias spring support for a bias spring 94. As shown in FIG. 9, a curved end 96 of a bias spring 94 engages a third coupler 81C, eliminating a need for a separate feature or component that serves as a bias spring support. Therefore, the couplers 81 can serve to not only torsionally couple the two camshaft phasers 20", 30", but also to assemble the second camshaft phaser 30" and serve as a bias spring support.

Figure 4B:
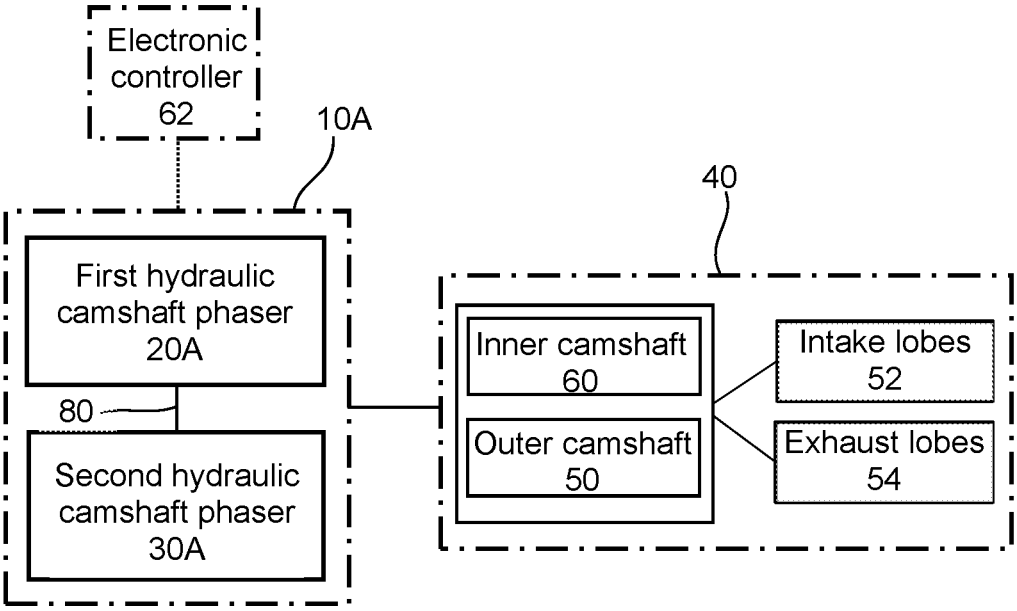
FIG. 4B is a schematic diagram of an example embodiment of a camshaft phaser arrangement with a first and a second hydraulically actuated camshaft phaser.

The previously described first camshaft phaser 20, 20', 20" and second camshaft phaser 30, 30', 30" can be actuated hydraulically with hydraulic fluid such as engine oil, electrically with an electric motor, or by any other actuation means. FIGS. 5 through 6 show a first camshaft phaser 20' that is electrically actuated, and a hydraulically actuated second camshaft phaser 30'. It could also be possible to have a hydraulically actuated first camshaft phaser and an electrically actuated second camshaft phaser. Furthermore, it could also be possible to have both camshaft phasers actuated in the same manner. In summary, the first and second camshaft phasers can include at least one of a hydraulic camshaft phaser or an electric camshaft phaser. Referring to FIG. 4B, a schematic diagram of a camshaft phaser arrangement 10A is shown together with an electronic controller 62 and the concentric camshaft assembly 40. The camshaft phaser arrangement 10A includes a first hydraulic camshaft phaser 20A and a second hydraulic camshaft phaser 30A. The first hydraulic camshaft phaser 20A is torsionally coupled to the second hydraulic camshaft phaser 30A by the couplers 80, and both camshaft phasers 20A, 30A are electronically controlled by the electronic controller 62. While FIG. 4B's camshaft arrangement 10A shows hydraulically actuated first and second camshaft phasers 20A, 30A, utilizing first and second electrically actuated camshaft phasers could also be possible.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser arrangement configured for a concentric camshaft assembly having inner and outer camshafts, the camshaft phaser arrangement comprising:

a first camshaft phaser configured to be connected to one of the inner or outer camshafts;

a second camshaft phaser configured to be connected to a remaining one of the inner or outer camshafts;

the first camshaft phaser axially adjacent to the second camshaft phaser; and, at least one coupler arranged to torsionally couple the first camshaft phaser to the second camshaft phaser, a first end of the at least one coupler received by at least one radial slot configured within one of the first or second camshaft phaser, and a second end of the at least one coupler connected to a remaining one of the first or second camshaft phaser.

2. The camshaft phaser arrangement of claim 1, wherein the at least one radial slot is configured to allow radial and axial movement of the at least one coupler.

3. The camshaft phaser arrangement of claim 1, wherein at least one of the first or second camshaft phaser is an electric camshaft phaser.

4. The camshaft phaser arrangement of claim 1, wherein at least one of the first or second camshaft phaser is a hydraulic camshaft phaser.

5. The camshaft phaser arrangement of claim 1, wherein the at least one radial slot is arranged on the first camshaft phaser and the second end of the at least one coupler is connected to the second camshaft phaser, the first camshaft phaser arranged axially outward of the second camshaft phaser.

6. The camshaft phaser arrangement of claim 5, wherein the first camshaft phaser includes a drive wheel configured with a power transmission interface.

7. The camshaft phaser arrangement of claim 6, wherein the at least one radial slot is arranged within the drive wheel.

8. The camshaft phaser arrangement of claim 5, wherein the second camshaft phaser includes a drive wheel configured with a power transmission interface.

9. The camshaft phaser arrangement of claim 5, wherein the at least one radial slot is arranged on at least one protrusion that extends from the first camshaft phaser.

10. The camshaft phaser arrangement of claim 5, wherein the first camshaft phaser is configured to be connected to the inner camshaft, and the second camshaft phaser is configured to be connected to the outer camshaft.

11. The camshaft phaser arrangement of claim 5, wherein the at least one coupler is a cylindrical pin.

12. The camshaft phaser arrangement of claim 11, wherein the second end of the cylindrical pin is received by an aperture arranged within the second camshaft phaser.

13. The camshaft phaser arrangement of claim 5, wherein the at least one coupler is a bolt.

14. The camshaft phaser arrangement of claim 13, wherein a first end of the bolt includes a shoulder and the second end of the bolt is formed with external threads received by an aperture formed with internal threads, the aperture arranged within the second camshaft phaser.

15. The camshaft phaser arrangement of claim 14, wherein the second end of the bolt is connected to a cover of the second camshaft phaser.

16. The camshaft phaser arrangement of claim 15, wherein the first and second camshaft phasers include at least one of a hydraulic camshaft phaser or an electric camshaft phaser.

17. The camshaft phaser arrangement of claim 1, wherein the at least one radial slot is arranged on the first camshaft phaser and the at least one coupler is arranged to attach a front cover and a rear cover to the second camshaft phaser, and the first camshaft phaser is arranged axially outward of the second camshaft phaser.

18. The camshaft phaser arrangement of 17, wherein the at least one coupler is configured with external threads that engage with the front cover.

19. The camshaft phaser arrangement of claim 17, wherein the at least one coupler serves as at least one bias spring support.

20. The camshaft phaser arrangement of claim 17, wherein the first camshaft phaser is configured to be connected to the inner camshaft, and the second camshaft phaser is configured to be connected to the outer camshaft.

* * * * *